US005522847A

United States Patent [19]

Kalis et al.

[11] Patent Number: 5,522,847

[45] Date of Patent: Jun. 4, 1996

[54] PACIFIER WITH NOVELTY ELECTRONIC DISPLAY

[76] Inventors: Amy G. Kalis, Pioneer 167 S. Stapley Dr.; Robert W. Kalis, 920 W. Natal Ave., both of Mesa, Ariz. 85204

[21] Appl. No.: 279,680

[22] Filed: Jul. 26, 1994

Related U.S. Application Data

[63] Continuation of Ser. No. 80,346, Jun. 18, 1993, abandoned.

[51] Int. Cl.[6] ..... A61J 17/00

[52] U.S. Cl. ..... 606/234; D24/194

[58] Field of Search ..... 362/104; 606/234–236; D24/194–199

[56] References Cited

U.S. PATENT DOCUMENTS

| | | | |
|---|---|---|---|
| D. 296,471 | 6/1988 | Marriott | D24/195 |
| D. 299,064 | 12/1988 | Berdt | D24/195 |
| D. 331,628 | 12/1992 | Dodson et al. | D24/195 |
| D. 337,386 | 7/1993 | Bierend | D24/194 |
| D. 345,215 | 3/1994 | Crossley et al. | D24/195 |
| 2,854,563 | 9/1958 | Catching | 362/104 |
| 4,076,976 | 2/1978 | Fenton | 362/104 |
| 4,215,388 | 7/1980 | Reimann | 362/104 |
| 5,176,704 | 1/1993 | Berndt | 606/236 |
| 5,178,467 | 1/1993 | Chen | 606/234 |
| 5,211,479 | 5/1993 | Coffey et al. | 606/234 |
| 5,239,450 | 8/1993 | Wall | 362/104 |

FOREIGN PATENT DOCUMENTS

| | | | |
|---|---|---|---|
| 0199005 | 10/1986 | European Pat. Off. | 606/234 |

*Primary Examiner*—Stephen C. Pellegrino
*Assistant Examiner*—Glenn Dawson

[57] ABSTRACT

A pacifier assembly including a distinct cover design having light emitting diodes located at the details of the cover design to provide entertainment to the viewer of the pacifier. One or more light emitting diodes are attached to the pacifier face plate and are activated by the use of the pacifier using a controller circuit and or a switch.

17 Claims, 7 Drawing Sheets

PACIFIER WITH NOVELTY ELECTRONIC DISPLAY

This application is a continuation of application Ser. No. 08/080,346, filed on Jun. 18, 1993, now abandoned.

BACKGROUND-FIELD OF INVENTION

The invention relates to a pacifier with an electronically enhanced display specifically to provide novelty to a pacifier design and or entertainment value to a viewer of the pacifier.

BACKGROUND-DESCRIPTION OF PRIOR ART

Pacifier devices have been designed to provide for the needs of a parent or infant in a variety of ways. Specifically, an infants needs may be taken care of by designs that provide orthopedically different nipples. Pacifiers have been designed with a ring holder that may aid the infant in motor skills when handling or to provide entertainment. Sound producing devices, U.S. Pat. No. 4,554,919 to Hubert (1985), have also been designed into pacifiers in an attempt to soothe or entertain an infant. A pacifier design with the parent in mind, U.S. Pat. No. 5,109,864 to Lu (1992), has been designed with a built in thermometer that serves the dual purpose of pacifying the infant while providing information about the baby. Yet another pacifier design, U.S. Pat. No. 4,716,902 to Swartz (1988), is provided as an aid to the parent in the act of placing a pacifier into the infants mouth in low or no light conditions. Other design provide for both the entertainment of the infant and the parent by providing the use of decorative face covers designs or by using glow in the dark materials, U.S. Pat. No. 5,007,924 to Jekel (1991).

All the pacifier designs heretofore known lack a distinct novelty that is designed to provide for the entertainment of the parent or viewer of the pacifier. Even those designs that attempt to use a visually appealing quality have been limited to plastic figures that lack visual action and are not stimulating to the eye of the viewer.

OBJECTS AND ADVANTAGES

The pacifier is being used with more confidence by the parent to soothe the baby. It has become an accessory feature and there are many choices of colors and designs.

This pacifier uses light emitting diodes to highlight a specific feature of the face cover and is a light-hearted, fun way to include baby in the celebration of the holidays or sporting events, but not limited to those ideas. It is a feature of the present invention to provide a pacifier with a lighted face cover that is used to stimulate and or amuse and or entertain those who view the pacifier.

DRAWING FIGURES

DESCRIPTION FIGS. 1 TO 4

Figure 1:
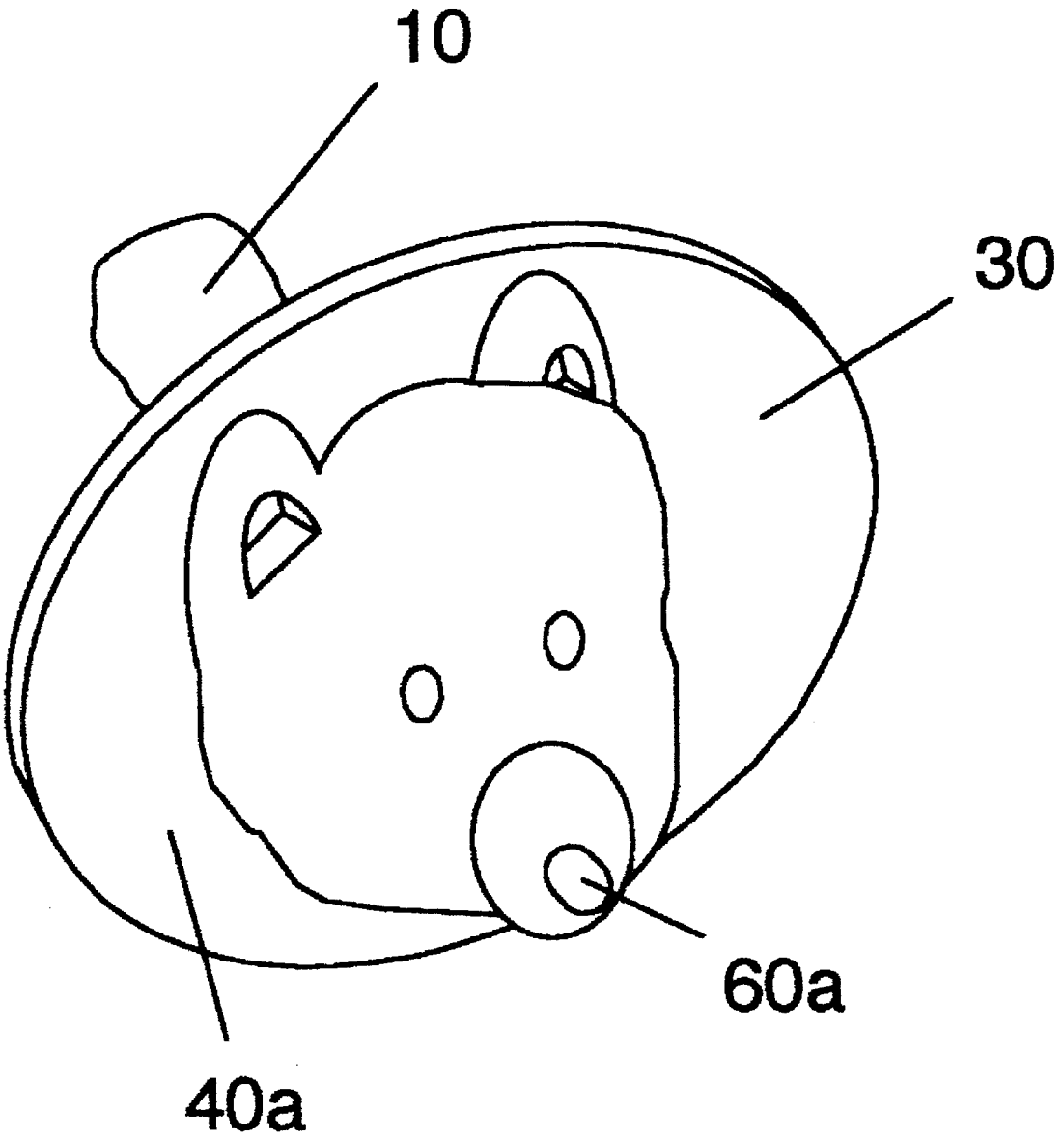
FIG. 1 shows an outside view of the pacifier assembly in accordance with the invention.
Figure 2:
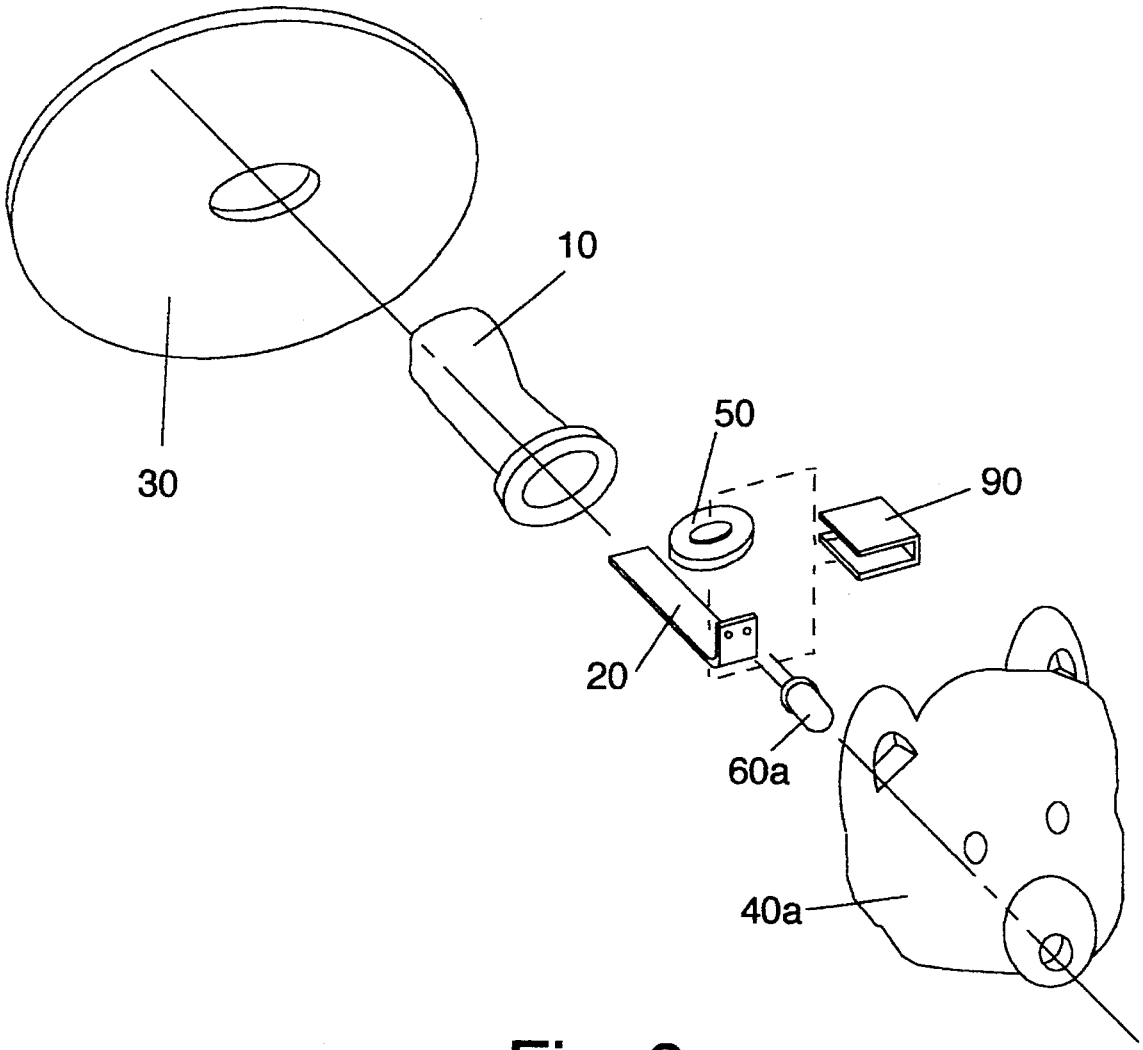
FIG. 2 shows an exploded view of the pacifier assembly in accordance with the invention.
Figure 3:
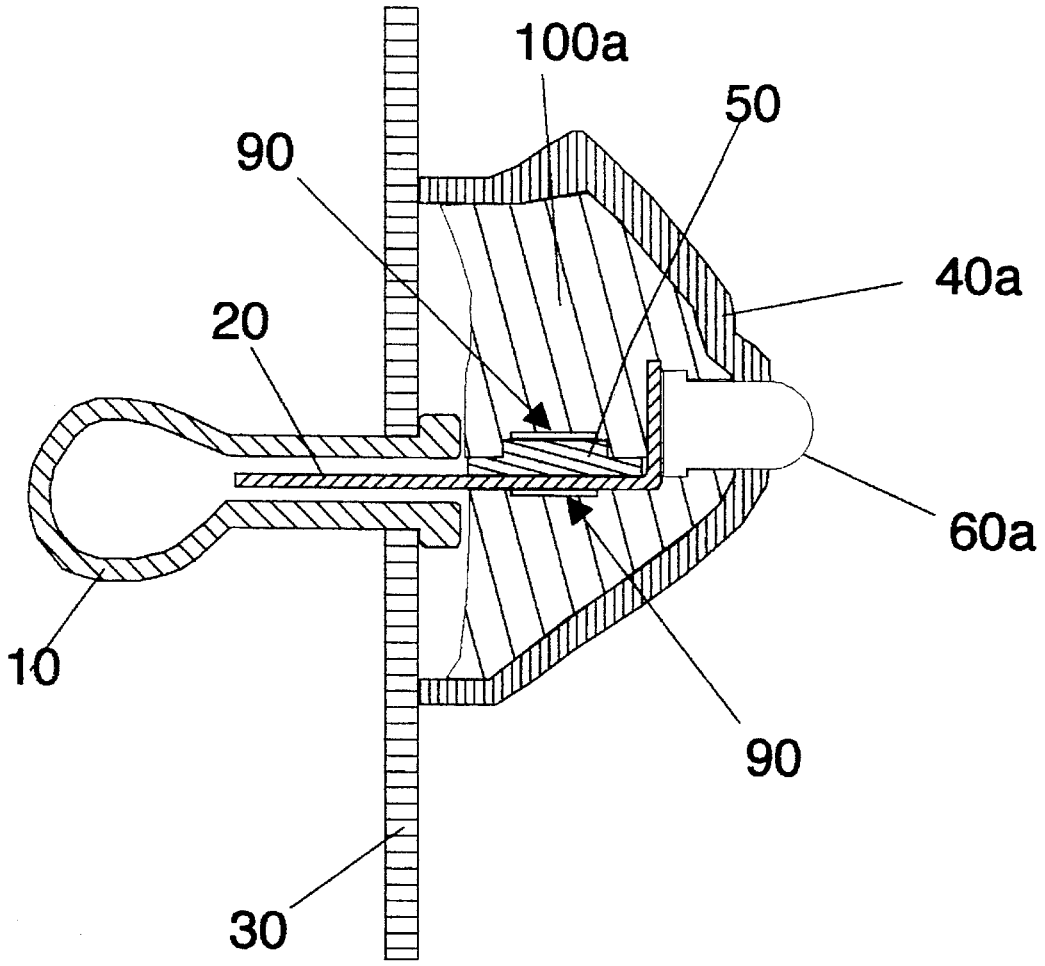
FIG. 3 shows a sectional view of the assembly in its assembled state.

FIGS. 1 and 2 show outside and exploded views respectively of the invention. FIG. 3 shows a sectional view of the invention. A nipple 10 made of soft plastic or rubber Epoxy backfill 100*b* is used to encapsulate power supply 50, contact 90, component board 80, display controller circuit 70 and part of activator 20 within the cavity of face cover 40*b* that is hollow and open at one end is placed through an oval opening in a face shield or base 30. Nipple 10 has a flange at the open end preventing it from being pulled through the oval opening in base 30. A switch or flexible membrane switch or activator 20 is inserted into nipple 10 and extends out the opening of nipple 10 into a face plate or cover 40*a*. Activator 20 is activated when nipple 10 is compressed in normal use. Attached to activator 20 is a light emitting diode (LED) 60*a*. A battery or power supply 50 provides light emitting diode 60*a* with the appropriated power. One polarity of power supply 50 is attached or in contact with activator 20. A metal conductor or contact 90 is connected to the other polarity of power supply 50. Contact 90 is also attached to activator 20. Light emitting diode 60*a* extends out from activator 20 and is seen through face cover 40*a*. Cover 40*a* is mounted to base 30 and secured using glue or ultrasonic welding. Face cover 40*a* holds nipple 10 into base 30 as well as providing support for activator 20. Face cover 40*a* and base 30 are made of hard or rigid plastic or rubber. Epoxy backfill 100*a* is used to encapsulate power supply 50, contact 90, and part of activator 20 within the cavity of face cover 40*a*.

Figure 4:
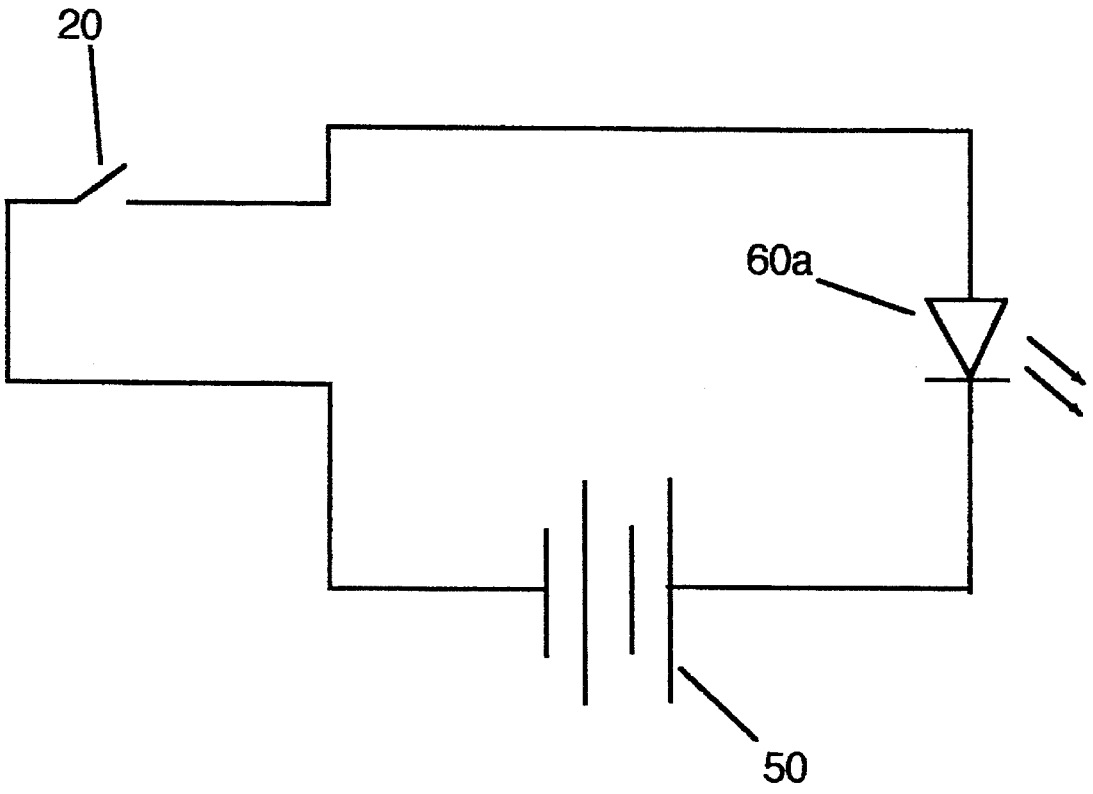
FIG. 4 shows a schematic view of the circuit used in the assembly in accordance with the invention.

FIG. 4 shows an electrical schematic of the invention. Power supply 50 supplies power to novelty electronic display 60*a*. When activator 20 is activated or closed, light emitting diode 60*a* is activated.

DESCRIPTION FIGS. 5 TO 7

Figure 5:
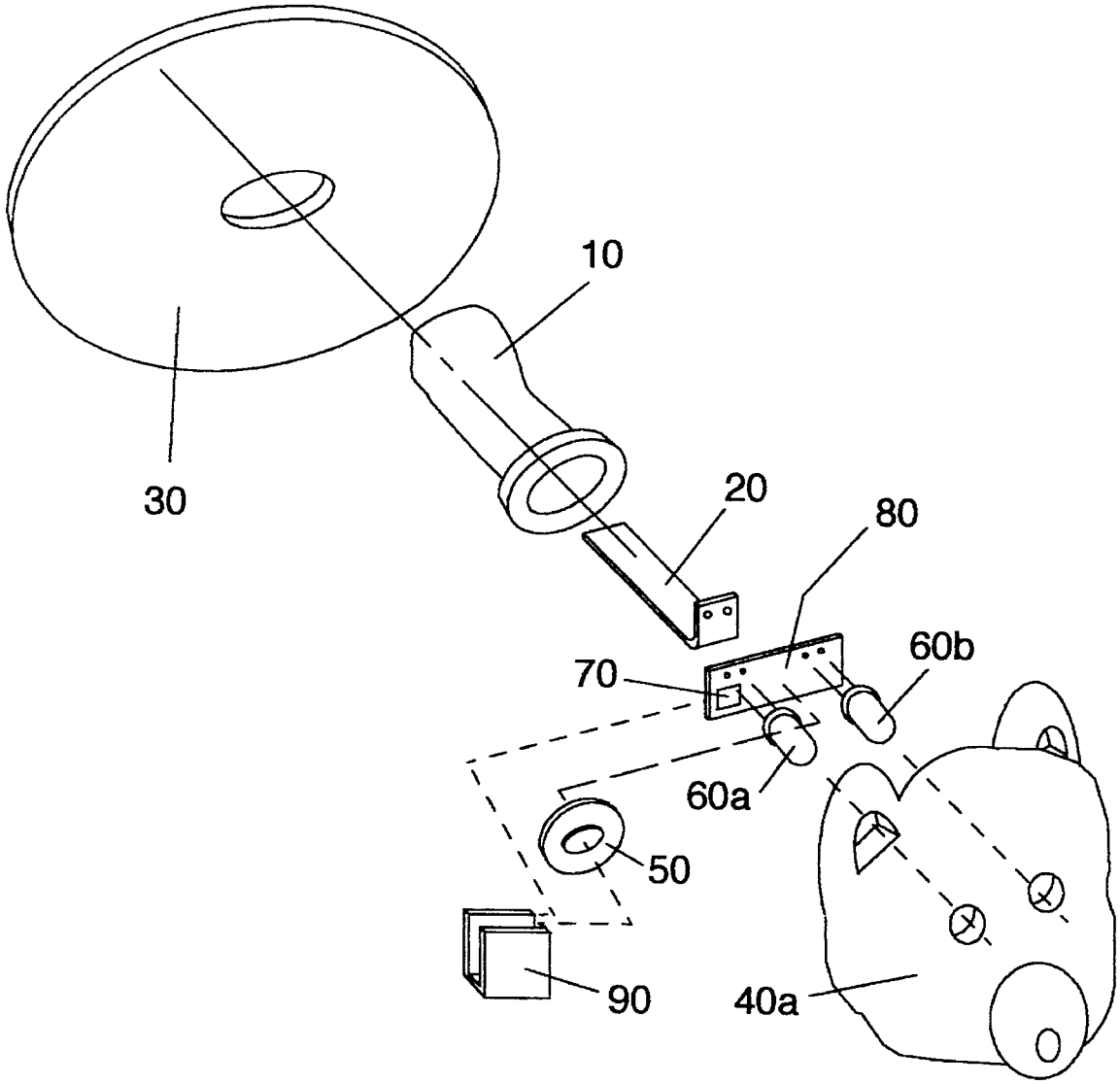
FIG. 5 shows an exploded view of the pacifier assembly with controller circuit in accordance with the invention.
Figure 6:
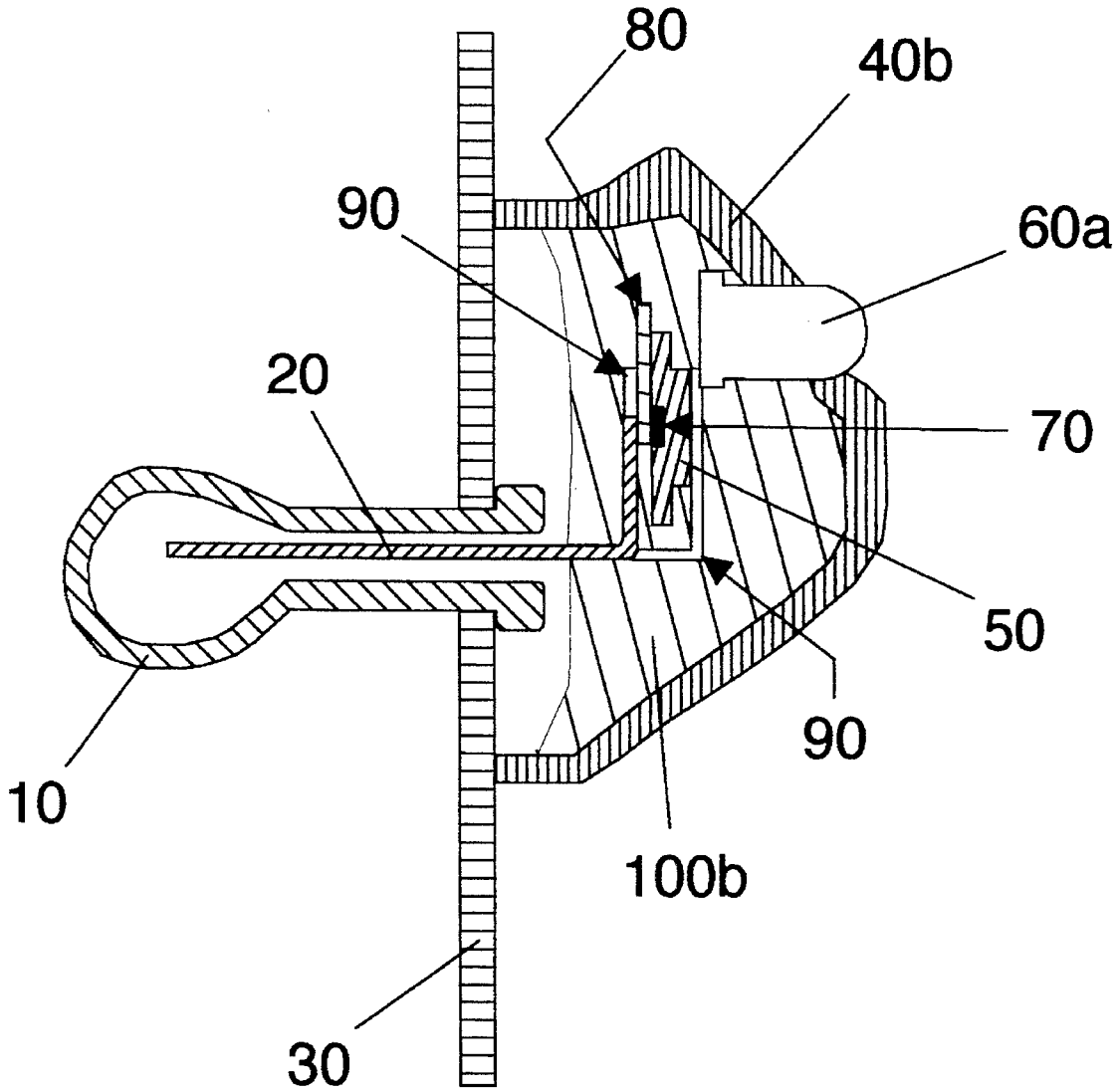
FIG. 6 shows a sectional view of the assembly with controller circuit in its assembled state.

FIG. 5 shows an exploded view of the invention. FIG. 6 shows a sectional view of the invention. A Nipple 10 made of soft plastic or rubber is placed through an oval opening in a face shield or base 30. Nipple 10 has a flanged opening at one end preventing it from being pulled through the oval opening in base 30. A flexible membrane or activator 20 is inserted into nipple 10 and is of sufficient length as to allow it to extend out of the open end of nipple 10 and be connected to a circuit board or component board 80. Activator 20 is activated when nipple 10 is compressed or in normal use. Also attached to component board 80 is a display controller circuit 70 that provides the electrical means to control light emitting diodes 60*a* and 60*b*. A battery or power supply 50 provides light emitting diodes 60*a*, 60*b*, and display controller circuit 70 with the appropriated power. One polarity of power supply 50 is attached or in contact with component board 80. A metal conductor or contact 90 is connected to the other polarity of power supply 50. Contact 90 is also attached to component board 80. 60*a* and 60*b* is attached to the component board 80 light emitting diodes 60*a* and 60*b* extend out from component board 80 and is seen through a face plate of face cover 40*b*. Face cover 40*b* is mounted to base 30 and secured using glue or ultrasonic welding. Face cover 40*b* provides a structural means to hold components board 80 in place. Face cover 40*b* also holds nipple 10 into base 30 as well as providing support for component board 80. Face cover 40*b* and base 30 are made of hard or rigid plastic or rubber.

Figure 7:
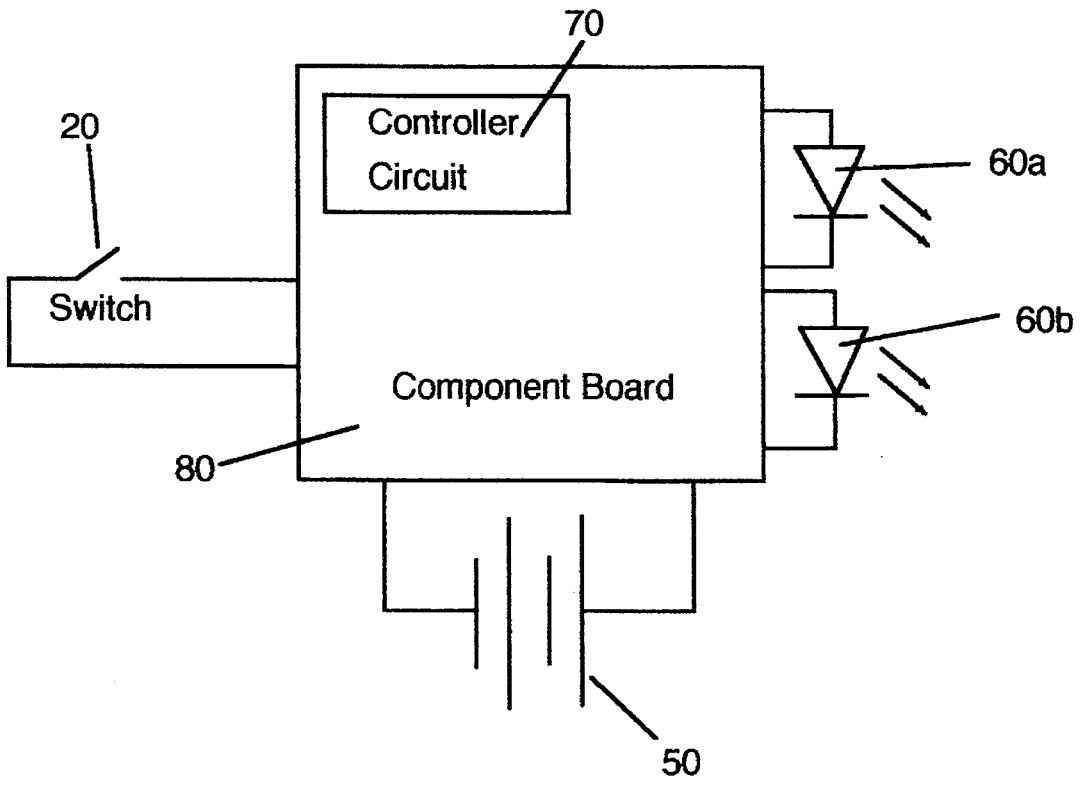
FIG. 7 shows a schematic view of the circuit used with controller circuit in the assembly in accordance with the invention.

FIG. 7 shows an electrical schematic of the invention. Power supply 50 supplies power to controller circuit 70 and to light emitting diodes 60*a* and 60*b*. Activator 20 activates controller circuit 70 mounted on component board 80 to activate light emitting diodes 60*a* and 60*b*.

OPERATION FIGS. 3 TO 4

Activator 20 will become electronically conductive when nipple 10 is compressed or in normal use as a pacifier as indicated in FIG. 3. As shown in FIG. 4, activator 20 will complete the circuit to power supply 50 causing light emitting diodes 60*a* to be activated. Once the nipple is in a relaxed state or no suction being applied to the nipple, activator 20 will open the circuit of FIG. 4 and deactivated light emitting diode 60*a*.

OPERATION FIGS. 6 TO 7

Activator 20 will become electronically conductive when nipple 10 is compressed or in normal use as a pacifier as indicated in FIG. 6. As shown in FIG. 7, activator 20 will signal display controller circuit 70 to begin a sequence that will activate light emitting diodes 60*a* and 60*b*. The predetermined sequence will repeat as long as activator 20 is in the closed position. Once the nipple is in a relaxed state or no suction being applied to the nipple, activator 20 will open the circuit of FIG. 7 and deactivate light emitting diodes 60*a* and 60*b* after the completion of the controller sequence.

SUMMARY, RAMIFICATIONS, AND SCOPE

The novel electronic display used in this pacifier invention has the advantage over prior or existing designs in that it is specifically designed to stimulate and or entertain, by electronic means, a viewer of the pacifier. The invention described above opens new avenues for unique pacifier display designs.

While the above descriptions contains many specificities, these shall not be construed as limiting the scope of the invention, but rather as an exemplification of one preferred embodiment thereof. Many other variations are possible. For example, the design in FIG. 5 may include a plurality of LED's having the same or different colors. The size and shape of the LED's may vary. The display controller circuit used to control the LED's may include energy saving techniques such as pulsing and multiplexing the LED's. The display controller circuit of FIG. 7 may use a predetermined sequence for the LED's activated by one activator contact or may step through a predetermined sequence with each activator closure. The sequence may terminate after one cycle even if the activator remains in the closed position. The design described for FIG. 5 may have a LCD display that may contain a plurality of section for activation. These section may comprise of, but is not limited to, alphanumeric symbols as well as figures, logos, phrases, sentences, words, slogans, seasonal symbols and figures, religious symbols and figures, sports related words, phrases and symbols. The display controller circuit of FIG. 5 may use a predetermined sequence for the LCD sections activated by one activator contact or may step through a predetermined sequence with each activator closure. The construction shown in FIGS. 3 and 6 may include an epoxy backfill that will inclose all electrical components with the exception of the activator.

Accordingly, the scope of the invention should be determined not by the embodiments illustrated, but by the appended claims and their legal equivalents.

I claim:

1. A pacifier, which comprises;

a plurality of light sources;

a cover having a cavity open at one end with an inner cavity surface and an outer surface:

a design means on said outer surface of said cover depicting a recognizable object and having one or more distinct details;

a nipple having a rounded end wall and defining a chamber, said nipple extending vertically away from said cavity of said cover;

a means for attaching said nipple to said cover;

said light sources specifically located at one or more said distinct details of said cover with said light sources located at least partially within said cavity of said cover and visible through said cover;

a power supply means at least partially within said cavity for supplying power to said light sources;

switching means for selectively engaging said light sources,

2. The pacifier of claim 1 wherein at least one said distinct detail of said cover is a nose and one said light source being visibly located at said nose of said cover.

3. The pacifier of claim 1 wherein two there are two said distinct details which are eyes and two said light sources are visibly located at each of said eyes.

4. The pacifier of claim 1 wherein said switching means includes a controller circuit means for electronically sequencing said light sources.

5. The pacifier in claim 4 wherein said controller circuit means is activated upon forces applied to said nipple.

6. The pacifier of claim 4 further comprising an epoxy backfill within the cover enclosing the electrical components of the power supply means and the controller circuit means.

7. The pacifier of claim 1 wherein said light sources are light emitting diodes; wherein said design means is selected from the group consisting of alphanumeric symbols, figures, sentences, slogans, seasonal symbols and figures, religious symbols and figures, sports related words and phrases and symbols.

8. The pacifier of claim 1 wherein one said distinct detail of said cover is a logotype.

9. The pacifier of claim 1 wherein one said distinct detail of said cover is at least one word.

10. The pacifier of claim 1 wherein one said distinct detail of said cover is a phrase.

11. The pacifier of claim 1 wherein said cover has an opening for each said light sources whereby said light sources form at least a portion of said distinct detail.

12. The pacifier in claim 1 wherein said switching means for selectively engaging said light sources is activated upon forces applied to said nipple.

13. The pacifier in claim 1 wherein said switching means for selectively engaging said light sources is a membrane switch.

14. A pacifier, which comprises;

a light emitting diode;

a cover forming a cavity open at one end with an inner cavity surface and outer surface;

a nipple having a rounded end wall and defining a chamber, said nipple extending vertically away from said cavity of said cover;

a means for attaching said nipple to said cover;

a design means on said outer surface depicting a face having of an animal a nose, at least partially;

said light emitting diode located at said nose of said design means of said cover with said light emitting diode located at least partially within said cavity of said cover and visible through said cover, a power supply means inside said cavity for supplying power to said light emitting diode;

and switching means at least partially within said cavity for selectively engaging said light emitting diode.

15. The pacifier in claim 14 wherein said cover has an opening for said light emitting diode whereby said light emitting diode forms at least a portion of said nose of said cover.

16. The pacifier in claim 14 wherein said switching means for selectively engaging said light emitting diode is activated upon forces applied to said nipple.

17. The pacifier in claim 16 wherein said means for selectively engaging said light emitting diode is a membrane switch.

* * * * *